United States Patent [19]

Folter et al.

[11] Patent Number: 4,657,162

[45] Date of Patent: Apr. 14, 1987

[54] LIQUID DISPENSING DEVICE WITH REMOVABLE DOSING UNIT

[75] Inventors: Hannes Folter; Christian C. Folter; Franz Gröbl, all of Vienna, Austria

[73] Assignee: Karl Fischer-Pochtler Gesellschaft m.b.H., Vienna, Austria

[21] Appl. No.: 894,477

[22] Filed: Aug. 5, 1986

Related U.S. Application Data

[63] Continuation of Ser. No. 682,160, Dec. 17, 1984, abandoned.

[30] Foreign Application Priority Data

Dec. 23, 1983 [AT] Austria ..... 4514/83

[51] Int. Cl.[4] ..... B65D 83/00

[52] U.S. Cl. ..... 222/402.25; 251/122; 251/323; 222/511; 222/501

[58] Field of Search ..... 222/402.25, 402.1, 394, 222/453, 399, 511, 501; 251/122, 118, 321, 322, 323

[56] References Cited

U.S. PATENT DOCUMENTS

| | | | |
|---|---|---|---|
| 2,064,696 | 11/1962 | Gruenewald | 222/402.05 |
| 2,530,583 | 11/1950 | Nurkiewicz | 222/402.25 |
| 2,638,108 | 5/1953 | Williams et al. | 251/323 |
| 2,642,261 | 6/1953 | Gates | 251/322 |
| 2,696,828 | 12/1954 | Husing | 251/122 |

FOREIGN PATENT DOCUMENTS

| | | | |
|---|---|---|---|
| 2543167 | 7/1977 | Fed. Rep. of Germany | 251/322 |

*Primary Examiner*—Joseph J. Rolla
*Assistant Examiner*—Kenneth Noland
*Attorney, Agent, or Firm*—Kurt Kelman

[57] ABSTRACT

Simple cleaning, exact dosing and a high degree of operating safety are assured with a dosing device for dispensing a liquid through a liquid dispensing nozzle from a container holding the liquid under pressure in the interior thereof, which comprises a liquid dosing piston displaceable along the axis thereof and housed in a bushing having a screw thread for attachment to the container. The piston has a valve body at an end thereof adjacent the interior of the container and a section of reduced cross section adjoining the valve body, the valve body having a cylindrical surface coaxial with the piston. An annular sealing gasket is arranged between the interior of the container and the liquid dispensing nozzle, the gasket being coaxial with the piston and the piston being displaceable between a sealing position wherein the valve body surface engages the gasket and a dispensing position wherein the valve body surface is out of engagement with the gasket, and a spring biases the piston for displacement into the sealing position.

1 Claim, 2 Drawing Figures

LIQUID DISPENSING DEVICE WITH REMOVABLE DOSING UNIT

Figure 1:
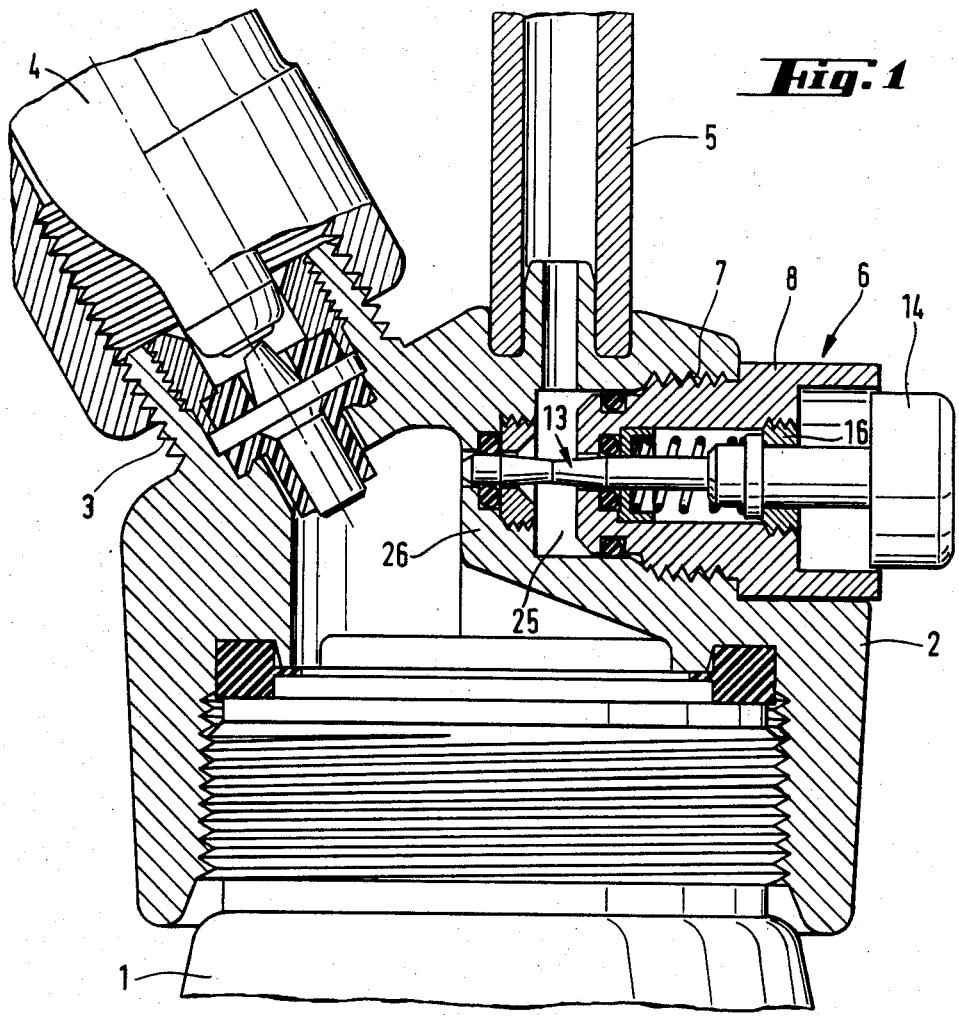

This is a continuation of our copending application Ser. No. 682,160, filed Dec. 17, 1984, now abandoned.

The present invention relates to improvements in a dosing device for dispensing a liquid through a liquid dispensing nozzle from a container holding the liquid under pressure in the interior thereof.

U.S. Pat. No. 4,194,653, dated Mar. 25, 1980, discloses a soda bottle with a liquid dispensing head threadedly mounted on the bottle. A dosing piston having a valve body at an end thereof extends in the dispensing head in a vertical direction and is displaceable by a pressure button against the bias of a spring. In a rest position, the spring presses the valve body against a sealing gasket whereby the interior of the bottle is sealed and prevents dispensing of liquid therefrom. By depressing the button, the dosing piston is moved down to enable the liquid to be dispensed. Such a dosing device is difficult to clean and requires the consumer to remove the entire dispensing mechanism.

DD-PS No. 97,176 discloses an actuating device for a tap fitting comprising a valve housing threadedly mounted in a tap housing, the inner end of a dosing piston being guided in the valve housing with a frustoconical valve body. The outer end of the dosing piston is mounted in a pressure button guided in a recess in the tap housing. This device has the disadvantage that it cannot be detached by the consumer.

It is the object of this invention to provide a dosing device for dispensing a liquid contained under pressure which is easy to clean, enables accurate dosing of the dispensed liquid and assures a high degree of operating safety.

The above and other objects are accomplished according to the invention with a dosing unit which comprises a liquid dosing piston displaceable along the axis thereof and housed in a bushing having a screw thread for attachment to the container. The piston has a cylindrical valve body section at an end thereof adjacent the interior of the container and a constricted valve body section adjoining the cylindrical same section, the cylindrical valve body having a cylindrical surface coaxial with the piston. An annular sealing gasket is arranged between the interior of the container and the liquid dispensing nozzle, the gasket being coaxial with the piston and the piston being displaceable between a sealing position wherein the cylindrical valve body section engages the gasket and a dispensing position wherein the cylindrical valve body section is out of engagement with the gasket, and a spring biases the piston for displacement into the sealing position.

Such a compact dosing unit has the advantage of enabling even unskilled consumers to detach the unit from the container for cleaning not only the dosing unit itself but also the connecting ducts between the interior of the container and the liquid dispensing nozzle. Since the dosing piston is housed in a detachable bushing forming an operating unit therewith, a high degree of safety is assured because there is no possibility of impairing the functioning of the device, for example by the loss of a small part, such as a spring or the like, during cleaning. This creates a subjective feeling of safety for the unskilled consumer who no longer is subject to anxieties of damaging the dosing device during relatively frequent cleanings necessary particularly if the liquid is relatively viscous, such as in dispensing creams. The ready detachability of the entire dosing unit also makes it possible to replace the device with ease by one better adapted to the viscosity of the liquid in the container.

Figure 2:
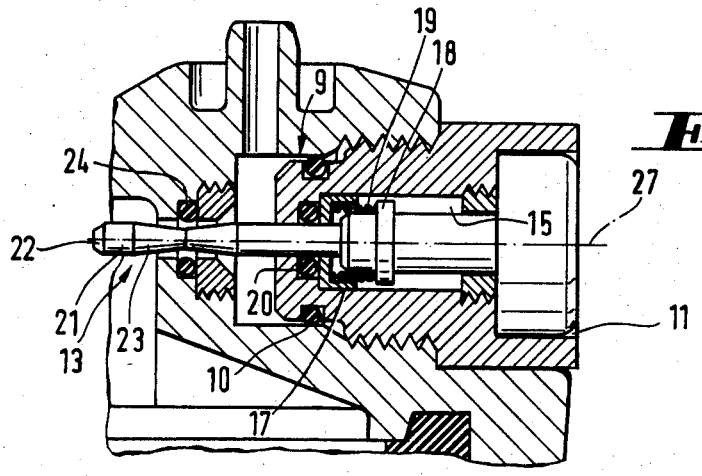

The above and other objects, advantages and features of the invention will become more apparent from the following detailed description of a now preferred embodiment thereof, taken in conjunction with the accompanying drawing wherein FIG. 1 shows an axial section of the dispensing head attached to the neck of a container and comprising a dosing device according to the present invention, the device being in its sealing position; and FIG. 2 is a like view of the dosing device in its dispensing position.

Referring now to the drawing, FIG. 1 shows a fragmentary view of container 1, showing only its neck portion on which head part 2 of the dispensing mechanism is detachably mounted. In the illustrated embodiment, the neck portion of the container has a thread meshing with an interior thread on head part 2 whereby the head part may be screwed to the neck portion of container 1. Head part 2 of the liquid dispensing mechanism has a threaded socket 3 on which cartridge 4 containing a compressed gas is detachably mounted and through which the compressed gas is in communication with the interior of container 1 to hold a liquid, such as a cream, contained therein under pressure. The head part also has a socket frictionally receiving and holding dispensing nozzle 5 thereon. In addition, head part 2 carries removable dosing unit 6 for dispensing dosed amounts of the liquid from container 1 through dispensing nozzle 5.

Dosing unit 6 comprises liquid dosing piston 13 having axis 27 and being displaceable along the axis. It further comprises bushing 8 having screw thread 7 for attachment to head part 2 attached to container 1 and which displaceably houses piston 13. The piston has a cylindrical valve body section 21 at an end thereof adjacent the interior of the container and constricted valve body section 23 adjoining the cylindrical valve body section. The cylindrical valve body section has cylindrical surface coaxial with piston 13. The dosing unit also comprises first annular sealing gasket 24 arranged between the interior of container 1 and liquid dispensing nozzle 5. Gasket 24 is coaxial with piston 13 and the piston is displaceable between a sealing position (shown in FIG. 1) wherein cylindrical valve body section 21 engages gasket 24 and a dispensing position (shown in FIG. 2) wherein the valve body section is out of engagement with the gasket. A spring means embodied by coil spring 19 biases piston 13 for displacement into the sealing position.

In the illustrated embodiment, bushing 8 has end 9 of a cross section reduced in relation to exterior thread 7 of the bushing between screw thread 7 and the interior of the container, and annular sealing gasket 10 is arranged in bushing end 9 of reduced cross section between head part 2 of the container and bushing end 9. This enables dosing unit 6 to be centered properly when bushing 8 is screwed into a meshing tapped bore in the head part while the path of the compressed sealing gasket is reduced to a minimum during the insertion of the bushing.

The outer end of bushing 8 defines pot-shaped recess 11 receiving and guiding actuating button 14 at an end of piston 13 opposite to the piston end having the valve body for pressing the piston into the dispensing position against the spring means bias. This arrangement makes it possible to hold container 1 securely in both hands while depressing push button 14 with one finger.

Annular spacing disc 16 is screwed into the bottom of recess 11 and guides the piston during its axial displacement, the spacing disc closing off the outer end of cylindrical bore 15 in bushing 8, the opposite end of the cylindrical bushing bore being closed by bottom 17. Annular shoulder 18 is arranged on piston 13 and coil spring 19 is mounted between bottom 17 and shoulder 18 for biasing the piston outwardly into a sealing position wherein shoulder 18 engages spacing disc 16 (see FIG. 1). Second annular sealing gasket 20 is mounted in bushing end 9 to provide a seal between the piston and bottom 17, gasket 20 coaxially surrounding a cylindrical piston section axially spaced from cylindrical valve body section 21.

In the illustrated embodiment, piston section 23 of reduced cross section is a constricted section of double conical shape and the valve body has a frusto-conical section 22 at an end thereof opposite adjoining piston section 23. Screw thread 7 of bushing 8 has at least twice the length of the valve body section 21. The double conical shape of constricted position section 23 enables the amount of the dispensed liquid to be varied in dependence on the displacement path of piston 13. The dispensed amount of liquid will be reduced to a minimum when the piston is displaced to its maximum. The frusto-conical end section 22 increases the safety of the device when it is removed while the liquid in the container is still held under pressure. Since the bushing screw thread is longer than the valve body, the gas and the liquid will flow out of the dispensing nozzle before the dosing device is fully detached. This is assured because the valve body has been pulled out of engagement with sealing gasket 24 before the dosing device has been completely detached and, therefore, full communication has been established between the interior of the container and the dispensing nozzle.

In the rest or sealing position of dosing unit 6, piston 13 is outwardly pressed by coil spring 19 until shoulder 18 engages spacing disc 16, in which end position cylindrical valve body section 21 engages annular sealing gasket 24. The gasket is positioned in partition wall 26 of head part 2 separating the interior of container 1 from intermediate liquid distribution chamber 25 defined between bushing end 9 and the partition wall, this intermediate chamber extending between dispensing nozzle 5 and the partition wall. In this way, the dispensing nozzle is sealed off from the interior of container 1 when valve body section 21 engages gasket 24 in a liquid flow passage defined by the partition wall 26 and extending coaxially with the piston between chamber 25 and the interior of the container.

When push button 14 is depressed to move piston 13 into the dispensing position shown in FIG. 2, cylindrical section 21 of the valve body has been axially displaced out of engagement with gasket 24 while constricted section 23 is in registry therewith to provide a liquid flow path between the interior of container 1 and intermediate chamber 25 to dispensing nozzle 5, thus causing the cream held under pressure in the interior of the container to flow out of the dispensing nozzle.

Dosing unit 6 constitutes a compact unit which may be screwed into and out of head part 2 of container 1. This enables intermediate chamber 25 and the connecting ducts from the interior of the container and to the dispensing nozzle in head part 2, as well as the valve body projecting from bushing 8, to be cleaned completely. The handling is so simple and so clearly excludes any possibility if losing a part that it encourages the consumer to clean the unit whenever required. At the same time, the dosing unit may be readily replaced, for example for a unit with a differently shaped reduced valve body section 23 adapted for a liquid of different viscosity.

While the invention has been described in connection with a now preferred embodiment, it will be understood by those skilled in the art that the illustrated structures may be replaced by equivalently operating structures without departing from the spirit and scope of this invention, as defined in the appended claims. For example, a lever pivoted to the bushing and actuating the axially displaceable piston may be substituted for push button 14.

What is claimed is:

1. A device for dispensing a liquid through a dispensing nozzle from a container having a neck portion and holding the liquid under pressure in the interior thereof, said liquid dispensing device comprising (a) a head part detachably mounted on the neck portion, the dispensing nozzle being mounted on the head part and the head part having
  (1) a partition wall and defining
  (2) a tapped bore extending outwardly from the partition wall, and (b) a removable dosing unit comprising
  (1) a bushing having a screw thread for attachment of the bushing to the bore, the bushing having an inner end spaced from the partition wall and defining a liquid distribution chamber therewith between the dispensing nozzle and the partition wall, the partition wall separating the interior of the container from the liquid distribution chamber,
  (2) a liquid dosing piston having an axis and being housed in the bushing for displacement along said axis, the piston having a cylindrical valve body section and a cylindrical section axially spaced from the cylindrical valve body section, a constricted valve body section of double conical shape therebetween, the cylindrical valve body section and the constricted valve body section protruding from the inner end of the bushing, and a frusto-conically tapering inner end adjacent the cylindrical valve body section,
  (3) the partition wall defining a liquid flow passage coaxial with the piston between the liquid distribution chamber and the interior of the container,
  (4) a first annular sealing gasket fixedly mounted on the partition wall in the liquid flow passage and coaxially surrounding the piston,
  (5) a second annular sealing gasket mounted in the bushing axially spaced from the first gasket and coaxially surrounding the cylindrical piston section for engagement therewith, the piston being displaceable between a sealing position wherein the cylindrical valve body section engages the first annular sealing gasket and a dispensing position wherein the cylindrical valve body section is out of engagement with the first annular sealing gasket and the constricted valve body section is in registry therewith for dosing the liquid flowing through the liquid flow conduit,
  (6) a spring means mounted in the bushing for biasing the piston for displacement into the sealing position, and
  (7) the bushing screw thread having at least twice the length of the inner cylindrical valve body section.

* * * * *